US006050666A

United States Patent [19]

Yeoh et al.

[11] Patent Number: 6,050,666

[45] Date of Patent: Apr. 18, 2000

[54] HIGH SPEED INKJET PRINTER AND METHOD OF USING SAME FOR IMPROVING IMAGE QUALITY

[75] Inventors: Hock Sin Yeoh; John F. Meyer, both of San Diego, Calif.

[73] Assignee: Hewlett-Packard Company, Palo Alto, Calif.

[21] Appl. No.: 08/935,392

[22] Filed: Sep. 23, 1997

[51] Int. Cl.[7] ..... B41J 29/38

[52] U.S. Cl. ..... 347/16; 347/17; 347/14

[58] Field of Search ..... 347/5, 14, 16, 347/17, 18, 19

[56] References Cited

U.S. PATENT DOCUMENTS

| | | | |
|---|---|---|---|
| 4,910,528 | 3/1990 | Firl et al. | 347/17 |
| 5,608,439 | 3/1997 | Arbeiter et al. | 347/102 |
| 5,781,205 | 7/1998 | Silverbrook | 347/17 |
| 5,844,583 | 12/1998 | Onishi et al. | 347/16 |

*Primary Examiner*—John Barlow
*Assistant Examiner*—Michael S Brooke
*Attorney, Agent, or Firm*—Jerry R. Potts

[57] ABSTRACT

A high speed full color inkjet printer switches automatically to a best print mode relative to minimum operating ambient temperature and a user selected printing media selected from a group of different types of medium.

22 Claims, 3 Drawing Sheets

HIGH SPEED INKJET PRINTER AND METHOD OF USING SAME FOR IMPROVING IMAGE QUALITY

TECHNICAL FIELD OF THE INVENTION

The present invention relates generally to high speed inkjet printers. More particularly, the present invention relates to a high speed inkjet printer and method of automatically controlling the printer print modes for improving image quality.

BACKGROUND OF THE INVENTION

Inkjet printers are efficient, quite and produce high quality print images in a relatively inexpensive manner when operated in low speed printing modes. Such quality is achieved by sweeping a large number of inkjet nozzles over a print medium and ejecting droplets of black ink onto the medium in one or more matrix arrays of minute ink drop patterns. Such arrays are known as swaths and the individual ink droplets are defined as pixels. The quality of the print image is then determined by assuring that each ink droplet has a precise volume of ink that is applied to a specific location on the print medium without smearing.

While such low speed inkjet printers have been satisfactory for many applications, there has been a constant demand for higher speed printers that produce high quality full color images. Meeting the demand for higher throughput while producing high quality, high ink density images however, has not been achieved easily. In this regard, in order to produce full vibrant colors on a print medium, large volumes of ink must be deposited in concentrated areas on the medium under proper environmental conditions. Failure to observe the proper environmental conditions relative to media and ink types may cause unwanted and undesired color degradation, ink smearing, and other undesired and unwanted hue shifts particularly at lower operating ambient temperatures.

One attempt at providing a satisfactory solution for printing high quality graphic images at a high throughput rate is disclosed in the Arbeiter et al. Patent (U.S. Pat. No. 5,608,439). The Arbeiter patent discloses a densitometer for adaptive control of ink drying time where a printer controller and an associated algorithm establish a variable delay time between sweeps. In this regard, the algorithm determines the maximum density of ink to be deposited in a given swath to control the amount of delay time between sweeps. In this manner rather than having a fixed delay time between individual sweeps, a variable delay time is implemented. This technique improves throughput but requires large amounts of processor time.

Although establishing a variable delay time between sweeps is an efficient method for improving throughput the disclosed technique does not consider the effects of ambient temperature on deposited ink droplets relative to different types and kinds of printing medium.

Therefore it would be highly desirable to have a new and improved inkjet printer and method that optimizes printing modes based upon the effects of ambient temperature on deposited ink droplets relative to different types and kinds of printing medium.

Another attempt at providing a satisfactory solution to avoiding ink smearing is disclosed in U.S. Pat. No. 4,910,528. The '528 patent discloses an algorithm solution involving temperature and printing demands. In this regard, a first determination algorithm calculates the number of ink droplets that will be deposited on a given page. A resulting density number provides a direct indicator of the printing demand to be placed on the printer. A second temperature predictive algorithm, utilizes the printing demand calculations, to determine the temperature change in the print head. The temperature differential provides a direct indicator of whether the operation of the print head for the printing activity will remain within acceptable temperature limits. A final algorithm, using the temperature indicator calculations, causes one of several mutually exclusive strategy actions to be taken involving the printing rate, the time permitted for print head cooling without printing and the heating of the print head when the a beginning temperature level is below an acceptable minimum temperature.

While the utilization of a variable sweep delay time and print head thermal control procedures has been successful in many applications, it would be highly desirable to have a new and improved printer and method for improving full color print quality images having densely inked areas on various types of print media without inhibiting carriage movement between swaths and without the need of using a combination of complex predictive algorithms.

SUMMARY OF THE INVENTION

A high speed full color inkjet printing system according to one aspect of the present invention includes a plurality of carriage mounted print head cartridges each having a plurality of inkjet nozzles for applying precise volumes of black and colorant ink droplets on a medium surface to form a full color high density graphic image without smearing and without inhibiting carriage travel between sweeps. The printing system includes an internal controller that responds to the print commands of a personal computer by selecting a best print mode based upon a current ambient temperature and the type of printing medium being employed for the image to be copied.

According to another aspect of the present invention a printing technique includes forming high quality graphic images at a high throughput rate in a best printing mode of operation relative to ambient temperature and the printing medium employed. The method comprises the a determination step to establish the kind of medium selected for the printing activity and a sensing step that monitors the ambient temperature for best printing mode selection purposes. A decision step relative to the sensed ambient temperature allows a user selected printing mode of operation to be carried out when the ambient temperature is above a predetermined minimum temperature level. Another decision step relative to the user selected medium, allows a best printing mode to be selected automatically when the temperature is below the predetermined minimum temperature level.

BRIEF DESCRIPTION OF THE DRAWINGS

The above mentioned features of this invention and the manner of attaining them will become apparent, and the invention itself will be best understood by reference to the following description of the embodiment of the invention in conjunction with the accompanying drawings, wherein.

DETAILED DESCRIPTION OF THE PREFERRED EMBODIMENT

Figure 1:
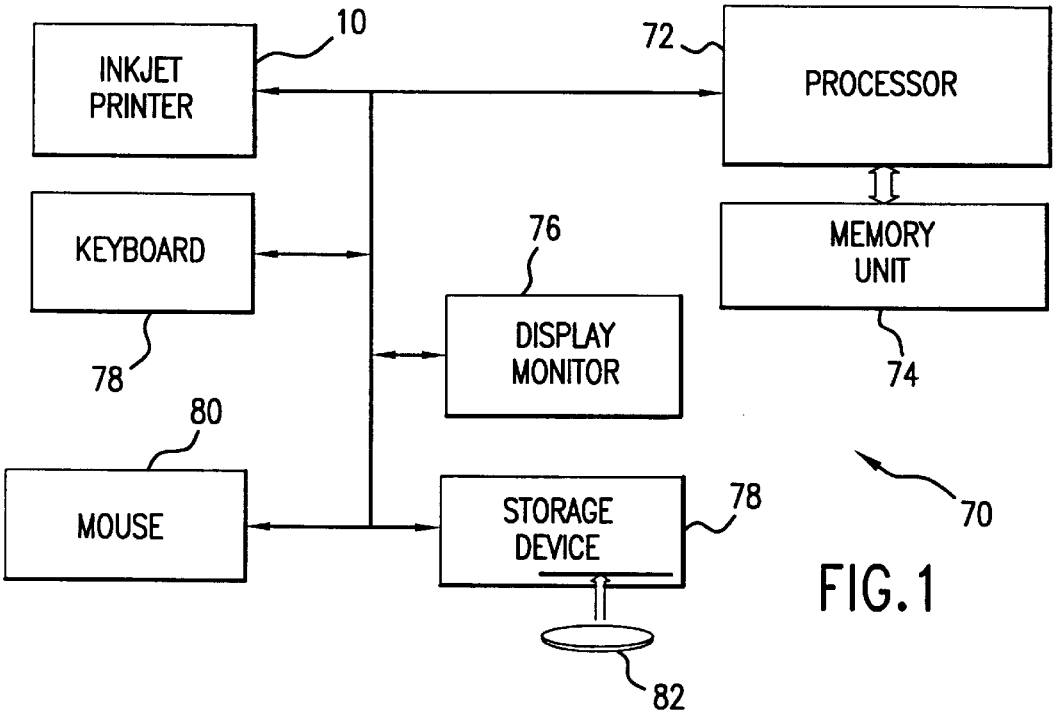
FIG. 1 is a block diagram of a high speed inkjet printer which is constructed in accordance with the present invention, illustrating the printer coupled to a personal computer system.
Figure 2:
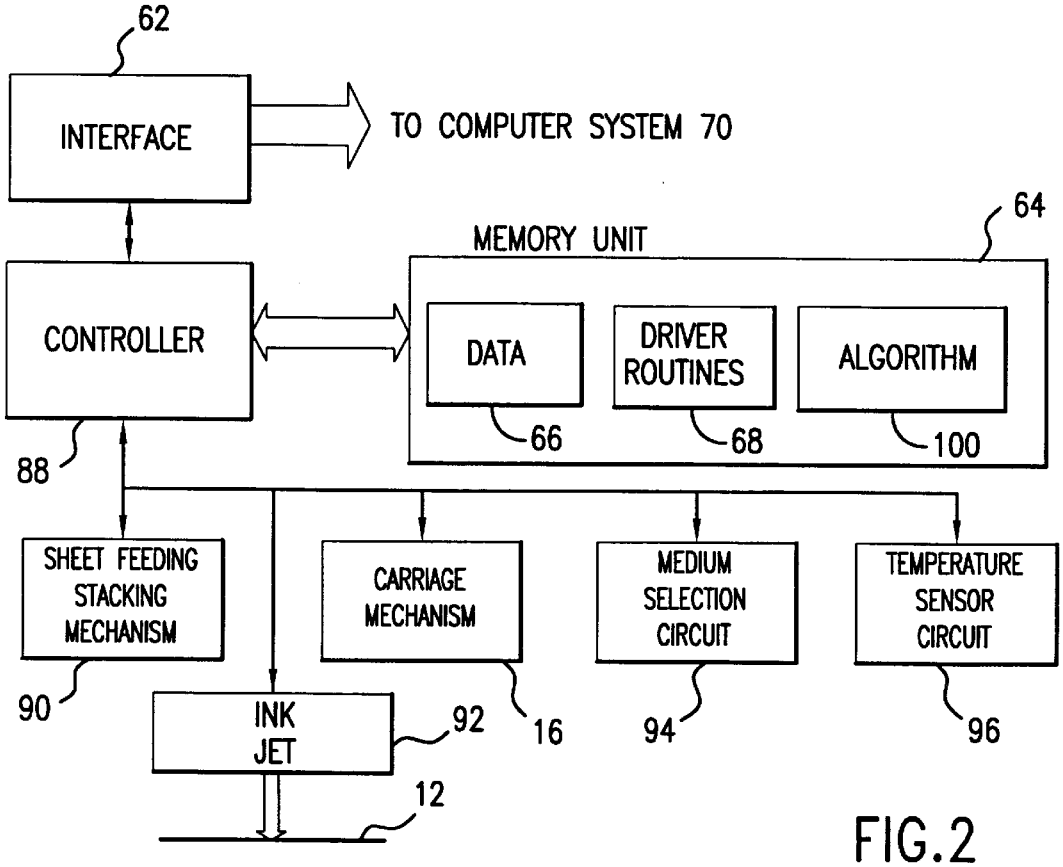
FIG. 2 is a block diagram of the high speed inkjet printer of FIG. 1, illustrating its main hardware components.
Figure 3:
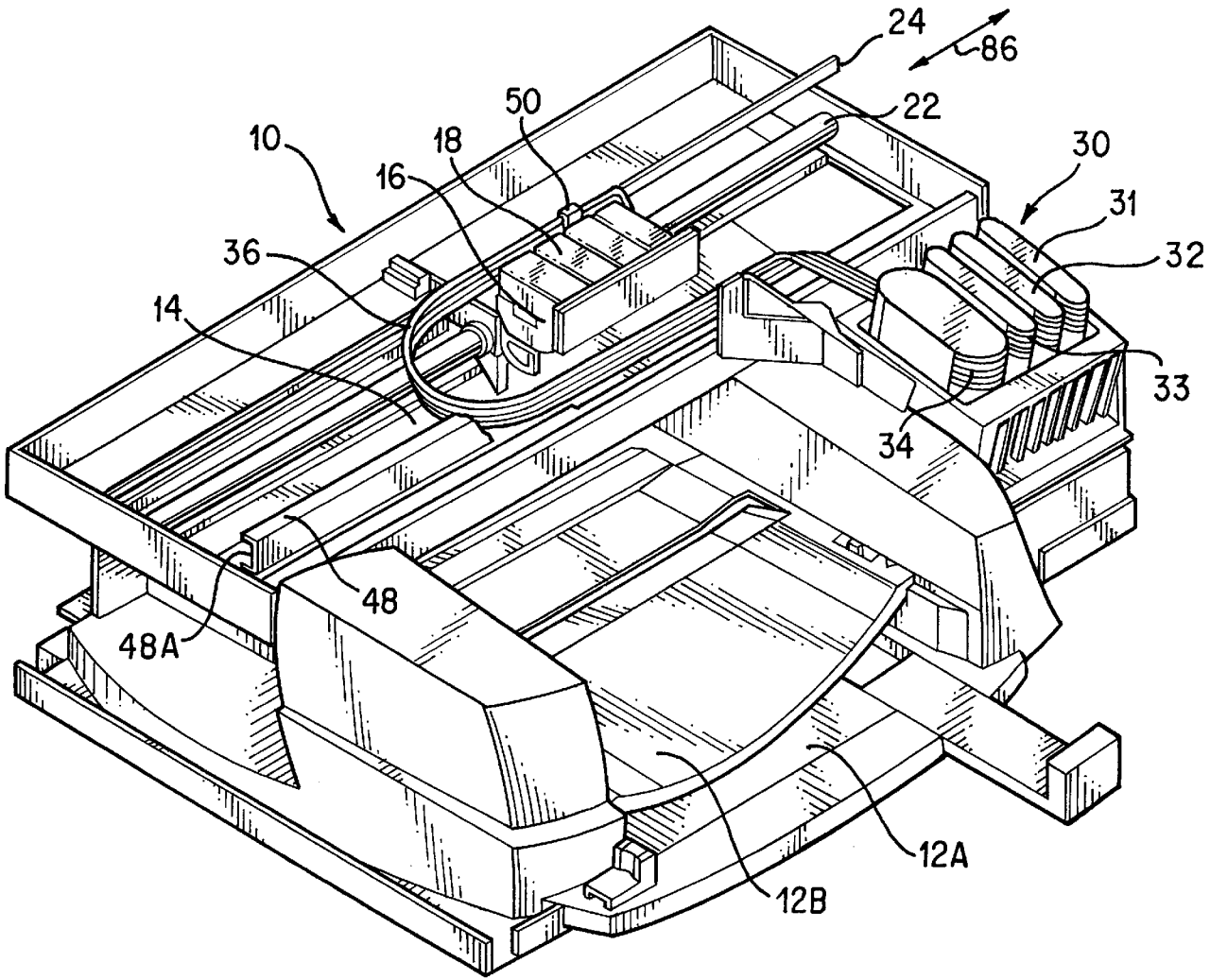
FIG. 3 is a pictorial view of the high speed inkjet printer of FIG. 1.

Referring now to the drawings and more particularly to FIGS. 1–3 thereof, there is shown a high speed inkjet printer 10 that is constructed in accordance with the present invention. The inkjet printer 10 illustrated in FIG. 1 functions as a system component in a personal computer system 70 by responding to print commands from a central processing unit 72 to print various full color as well as black print images in the form of objects or textual information which has been stored in a memory unit 74 associated with the a central processing unit 72 or on a storage media 82, such as a removable compact disc. The storage media 82 is adapted to function in a read and write mode of operation with a storage device 78 coupled to the central processing unit 72. To facilitate a user friendly interface for interactive operations, the computer system 70 also includes a plurality of computer peripheral devices, such as a display monitor 76 to enable a user to visualize the objects or textual information to be printed, a computer keyboard 78 that enables the user to enter information for command or information storage purposes, and a computer mouse 80 that facilitates input and output operations. FIG. 3 is a perspective view showing an exemplary embodiment of the printer 10 with its cover removed.

In operation, the high speed inkjet printer 10 responds to commands from the central processing unit 72 by printing full color or black print images on a sheet of paper 12 (FIG. 2) or other form of printing medium, such as a transparency which is mechanically retrieved from a medium holding or supply tray 12A that holds a given amount of the printing medium. The given amount of printing medium that can be held by the supply tray 12A varies between a single sheet, such as the sheet 12, to a predetermined maximum quantity The printer 10 operates in a single pass printing mode to cause one or more swaths of ink droplets to be ejected on to the printing medium to form a desired image. Each swath is formed in a pattern of individual dots at particular locations of an array defined for the printing medium . The locations are conveniently visualized as being small dots in a matrix array. The locations of the individual ink droplets are known as "dot positions,"or "pixels." A movable print carriage 16 having one or more print cartridges, such as a print cartridge 18 is supported from below on a slide rod 22 that permits the carriage 16 to move along a rectilinear path of travel whose direction is indicated generally at 86. The path of travel followed by the print carriage 16 is traverse to the path of travel followed by the sheet 12 as it passes through a print zone 14. In this regard, when a print operation is initiated by an internal print controller 88 in response to a print command from the processor 72, a sheeting feeding stacking mechanism 90 caused the sheet 12 to be moved from the supply tray 12A along a medium path of travel within the printer 10 into the print zone 14 where the sheet is temporarily stopped for printing purposes. When the sheet stops along its path of travel, a carriage mechanism 92 causes the carriage 16 to scan across the sheet allowing the print cartridges, such as the print cartridge 18 to eject drops of ink at appropriate times pursuant to the command of the print controller 88, wherein the timing of the application of the ink drops onto the sheet correspond to the pattern of pixels of the image being printed.

After the first swath of ink droplets is deposited onto the sheet 12, a stepper motor in combination with a set of feed rollers (not shown) forming part of the sheet feeding stacking mechanism 90 cause the sheet to be incrementally shifted or moved along its path of travel to a next printing position within the print zone 14. When the sheet 12 comes to rest at the next position in the print zone 14, the carriage 16 is scanned across the sheet in an opposite direction along its path of travel for printing a next swath of ink. When the sheet 12 has been advanced through each of its printing positions in the print zone 14 so that printing of the desired information is completed, the sheet is moved from the print zone to a temporary holding or post drying position located above an output tray 12B. The holding of the sheet 12 at the post drying position helps facilitate a drying period that is sufficiently long to assure that the ink deposited onto the sheet 12 is dry, before the sheet 12 is released and received into the output tray 12B. In this manner, the smearing of wet ink on the sheet is prevented.

In order to facilitate the determination of the different types of media utilized in the various printing activities performed by the printer 10, a media selection circuit 94 is coupled to the controller 88. The media selection circuit generates a media signal that is indicative of the type of media that has been selected for a current printing activity. The selection circuit 94 defaults to the most common media utilized by the printer 10 by defaulting to a cotton paper bond selection.

As best seen in FIG. 2, the printer 10 also includes a temperature sensor circuit 96 for generating a temperature signal that is indicative of the ambient temperature at about the printer. The temperature sensor circuit 96 includes a temperature sensor (not shown) that is utilized to sense ambient air temperature circulating into the printer 10 from the outside atmosphere. The temperature sensor circuit 96 further includes an analog to digital conversion circuit that is coupled to the temperature sensor for converting its output signal into a digital signal indicative of the ambient temperature.

Considering now the operation of the printer 10 in greater detail with reference to FIGS. 4–7, to print a given object or textual information on the medium 12, the computer system 70 causes a print command to be sent to the printer 10. The object or textual information to be printed is also sent to the printer 10 and is stored in the data area 66 of the memory unit 66 as a plot profile file.

The controller 88 that controls the storing of the plot file in the memory unit 64 determines via a control algorithm 100 whether the object or textual information is to be printed should be printed in a user selected print mode or an automatic best print mode based upon a current ambient temperature and the type of medium being utilized in the printing activity.

In order to switch printing modes automatically, the controller 88 operating under the commands of the algorithm 100 determines whether the ambient temperature is above an optimum minimum operating temperature to provide the best quality of printed image for the specific ambient temperature.

As will be explained hereinafter in greater detail, a medium selection subroutine 200 determines whether the user selected medium is the correct medium for the current printing activity using a lookup table stored in the memory unit 64. If the user selected medium is not the correct medium type for the selected printing activity, the controller 88 causes the printing activity to be performed in the printing mode selected by the user. However, if the user selected medium is the correct medium type for the selected printing activity, the controller 88 determines the best printing mode for the selected printing activity relative to the operating temperature and then automatically selects the best mode. The print command is then executed by the controller 88 to cause the object or textual information to be printed on the selected medium.

Figure 4:
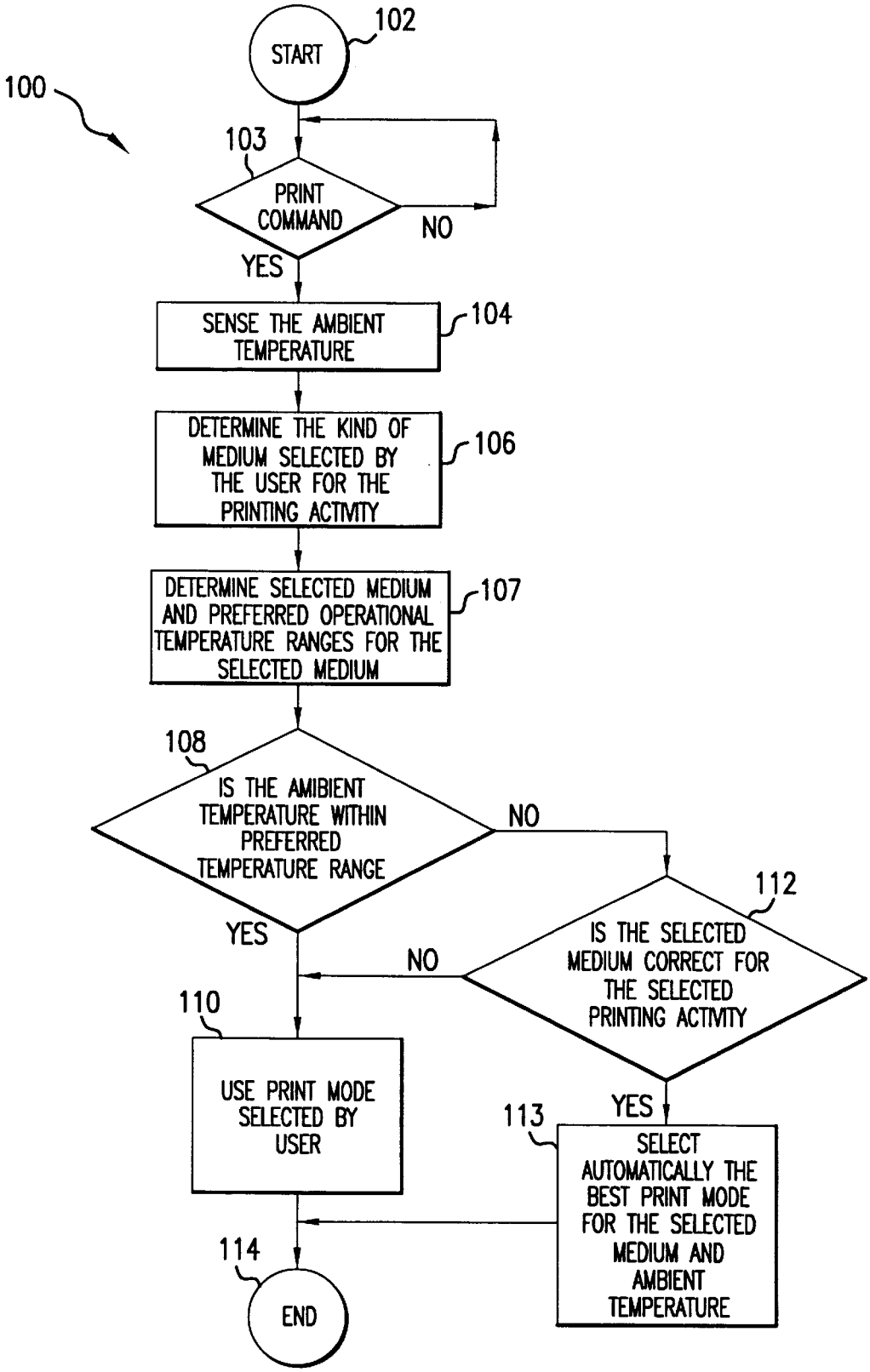
FIG. 4 is a flow chart showing the steps performed by the print controller of FIG. 2 in selecting a best print mode operation.

Considering now the steps performed by the controller 88 carrying out the algorithm 100 with reference to FIG. 4, in this exemplary embodiment the controller 88 begins the algorithmI 100 at a start command step 102 when power is applied to the controller 88. The controller 88 then enters an idle mode at a decision step 103 waiting for the processor 72 to send a print command.

When the processor 72 initiates a print command, the printer control program 100 advances to a command step 104 to cause the controller 88 to store the current ambient temperature that is sensed by the temperature sensor circuit 96. Next in a command step 106 the controller 88 samples the medium selection circuit 94 to determine the kind of media that has been selected by the user for the current print activity. The program 100 then proceeds to a command step 107 to determine the preferred operational temperature range for the selected medium.

The program 100 then advances to a decision command 108 that determines whether the ambient or environmental temperature of the printer 10 is within an optimum operating temperature range of between about T degrees centigrade and about T1 degrees centigrade. The preferred operating temperature ranges between about T degrees centigrade and about T1 degrees centigrade for each of the different types of media are shown in Table No. 1:

TABLE No. 1

| Media Type | Preferred Temperature (Degrees Cent.) | More Preferred Temperature (Degrees Cent.) | Most Preferred Temperature (Degrees Cent.) |
|---|---|---|---|
| Bond | 20–30 | 20–25 | 20 |
| Glossy | 20–35 | 20–30 | 25 |
| Matte | 20–35 | 20–30 | 25 |

If a determination is made at step 108 that the ambient temperature is within the preferred range, the program goes to a command step 110 that instructs the controller 88 to use the print mode selected by the user as an acceptable printed reproduction will result.

If a determination is made at step 108 that the ambient temperature is not within the preferred range, the program advances to a decision command 112. In step 112, the control program 100 causes the controller 88 to determine whether the medium selected is the correct medium for the printing activity requested.

If a determination is made in step 112 that the selected media is not the correct medium for the selected print activity, the program advances to the command step 110 that causes the print operation to be performed in the print mode selected by the user.

If the selected media is the correct type of media for the current requested print activity, the program advances to a command step 113 that causes the controller 88 to switch its printing mode to the best print mode at a specific set point for the kind of media relative to the operating temperature selected. In this manner, the control program 100 causes the controller 88 to automatically switch to the print mode that assures consistent print quality. Thus, by automatically switching from the mode selected by the user, the controller 88 under control of the program 100, eliminates the printing of an unacceptable print copy.

Once the best printing mode has been selected by the controller 88, the control program 100 causes the selected print activity to be completed by printing the desired object or textual information on the printing media 12. The program than proceeds to the print command step 103 and continues as previously described by waiting for the next print command to be received from the processor 72.

We claim:

1. An inkjet printer. comprising:

a temperature sensor circuit for generating a temperature signal indicative of the ambient temperature;

a medium selection circuit for generating a media signal indicative of the kind of media selected for a current requested printing activity;

a print mode selection circuit for generating a mode signal indicative of a user selected printing activity; and a controller responsive to said temperature signal and to said media signal for determining whether the ambient temperature is within an optimum operating temperature range of between about T degrees Centigrade and about T1 degrees Centigrade for the kind of media selected for a current requested printing activity; and said controller responsive to said mode signal and to said media signal for printing desired information in a user selected print mode when the ambient temperature is within said optimum operating temperature range of between about T degrees Centigrade and about T1 degrees Centigrade and for printing desired information in a controller selected print mode when the ambient temperature is not within said optimum operating temperature range of between about T degrees Centigrade and about T1 degrees Centigrade.

2. An inkjet printer according to claim 1, further comprising:

a memory storage unit coupled to said controller for receiving data to be printed; and a control program stored in said memory unit for causing said controller to respond to said temperature signal and to said media signal for selecting said best printing mode of operation.

3. An inkjet printer according to claim 2, wherein said control program includes an algorithm for selecting a best printing mode from a plurality of different printing modes based upon a selected media and a sensed ambient temperature of between about T degrees centigrade and about T1 degrees centigrade.

4. An inkjet printer according to claim 3, wherein said selected media is selected from a group of different types of media.

5. An inkjet printer according to claim 4, wherein said group of different types of media include bond, glossy and matte mediums.

6. An inkjet printer according to claim 5, wherein said plurality of different printing modes includes a best minimum ambient temperature printing mode when said sensed ambient temperature range is between about 20 degrees centigrade and about 35 degrees centigrade.

7. An inkjet printer according to claim 6, wherein a more preferred sensed ambient temperature range is between about 20 degrees centigrade and about 30 degrees centigrade.

8. An inkjet printer according to claim 7, wherein a most preferred sensed ambient temperature is about 25 degrees Centigrade.

9. An inkjet printer according to claim 3, wherein said selected media is bond paper.

10. An inkjet printer according to claim 9, wherein said plurality of different printing modes includes a best minimum ambient temperature printing mode when said sensed ambient temperature is between about 20degrees centigrade and about 30 degrees centigrade.

11. An inkjet printer according to claim 10, wherein a more preferred ambient temperature is between about 20 degrees centigrade and about 25 degrees centigrade.

12. An inkjet printer according to claim 11, wherein a most preferred ambient temperature is about 20 degrees centigrade.

13. A method of selecting a best printing mode of operation, comprising:

generating a temperature signal indicative of the ambient temperature;

generating a media signal indicative of a kind of media selected for a currently indicated printing activity; and selecting a best printing mode of operation for said printer in response to said temperature signal and to said media signal;

generating a mode signal indicative of a user selected printing activity;

determining whether the ambient temperature is within an optimum operating temperature range of between about T degrees Centigrade and about T1 degrees Centigrade for the kind of media selected for a current requested printing activity;

printing desired information in a user selected print mode when the ambient temperature is within said optimum operating temperature range of between about T degrees Centigrade and about T1 degrees Centigrade: and printing desired information in a controller selected print mode when the ambient temperature is not within said optimum operating temperature range of between about T degrees Centigrade and about T1 degrees Centigrade.

14. In combination with a personal computer system having a processor and a plurality of input/output devices, an inkjet printer, comprising:

a temperature sensor circuit for generating a temperature signal indicative of the ambient temperature;

a medium selection circuit for generating a media signal indicative of the kind of media selected for a currently selected printing activity;

a print mode selection circuit for generating a mode signal indicative of a user selected printing activity: and a controller responsive to said temperature signal and to said media signal for determining whether the ambient temperature within an optimum operating temperature range of between about T degrees Centigrade and about T1 degrees Centigrade for the kind of media selected for a current requested printing activity; and said controller responsive to said mode signal and to said media signal for printing desired information in a user selected print mode when the ambient temperature is within said optimum operating temperature range of between about T degrees Centigrade and about T1 degrees Centigrade and for printing desired information in a controller selected print mode when the ambient temperature is not within said optimum operating temperature range of between about T degrees Centigrade and about T1 degrees Centigrade.

15. An inkjet printer according to claim 14, further comprising:

a memory storage unit coupled to said controller for receiving data to be printed; and a control program stored in said memory unit for causing said controller to respond to said temperature signal and to said media signal for selecting said best printing mode of operation.

16. An inkjet printer according to claim 15, wherein said control program includes an algorithm for selecting a best printing mode from a plurality of different printing modes based upon a selected media and a sensed ambient temperature of T degrees Centigrade.

17. An inkjet printer according to claim 16, wherein said plurality of different printing modes includes a best minimum ambient temperature printing mode when said sensed ambient temperature T is between about 20 degrees Centigrade and about 30 degrees Centigrade.

18. An inkjet printer according to claim 17, wherein a more preferred sensed ambient temperature T is between about 20 degrees Centigrade and about 25 degrees Centigrade.

19. An inkjet printer according to claim 18, wherein a most preferred sensed ambient temperature T is about 20 degrees Centigrade.

20. An inkjet printer according to claim 16, wherein said selected medium is selected from the group of bond paper, glossy paper, and matte paper.

21. An inkjet printer having a carriage unit for holding a least one print head, comprising:

a controller for controlling the carriage unit and print head to print a desired image;

said controller responsive to a temperature signal indicative of a current ambient temperature and to a media signal indicative of the kind of media selected by a user for a currently requested printing activity for determining whether the ambient temperature is within an optimum operating temperature range of between about T degrees Centigrade and about T1 degrees Centigrade for the kind of media selected for the currently requested printing activity; and said controller further responsive to a mode signal indicative of a user selected print mode for the currently selected printing activity and to said media signal for printing desired information in said user selected print mode when the ambient temperature is within said optimum operating temperature range of between about T degrees Centigrade and about T1 degrees Centigrade and for printing desired information in a controller selected print mode when the ambient temperature is not within said optimum operating temperature range of between about T degrees Centigrade and about T1 degrees Centigrade.

22. A method of operating an inkjet printer having a carriage unit for holding a least one print head, comprising:

controlling the carriage unit and print head to print a desired image;

wherein said step of controlling includes:

determining whether the ambient temperature is within an optimum operating temperature range of between about T degrees Centigrade and about T1 degrees Centigrade for the kind of media selected for a currently requested printing activity; and printing desired information in a user selected print mode when the ambient temperature is within said optimum operating temperature range of between about T degrees Centigrade and about T1 degrees Centigrade; and printing desired information in a controller selected print mode when the ambient temperature is not within said optimum operating temperature range of between about T degrees Centigrade and about T1 degrees Centigrade.

* * * * *